US005236223A

United States Patent [19]

Leon et al.

[11] Patent Number: 5,236,223

[45] Date of Patent: Aug. 17, 1993

[54] SKI POLE

[76] Inventors: Raul Leon, 1500 Country Vistas La., Bonita, Calif. 91902; Timothy J. Miranda, 49 E. Flower St., #259, Chula Vista, Calif. 91910

[21] Appl. No.: 913,881

[22] Filed: Jul. 16, 1992

[51] Int. Cl.[5] ..... A63C 11/22

[52] U.S. Cl. ..... 280/821; 280/819

[58] Field of Search ..... 280/819, 824, 823, 821; 135/65

[56] References Cited

U.S. PATENT DOCUMENTS

| | | | |
|---|---|---|---|
| 3,368,811 | 2/1968 | Finney | 280/821 |
| 4,728,123 | 3/1988 | Kassal et al. | 280/822 |
| 5,058,923 | 10/1991 | Dale | 280/821 |

FOREIGN PATENT DOCUMENTS

| | | | |
|---|---|---|---|
| 2616575 | 10/1977 | Fed. Rep. of Germany | 280/819 |
| 2609639 | 7/1988 | France | 280/821 |
| 527678 | 10/1940 | United Kingdom | 280/819 |

*Primary Examiner*—David M. Mitchell

*Attorney, Agent, or Firm*—Frank D. Gilliam

[57] ABSTRACT

A ski pole for down hill or cross country skiing. The pole has a coaxial handle end and tip end with a plurality of obtuse angled bends therebetween. The handle end includes a hand grip with attached Velcro type hook or eye attachment material which mates with eye or hook material carried by the hand of the skier. At the end opposite to the handle the pole tip is bent back on itself at an acute angle for a selected distance and then is further formed perpendicular to the axis of the handle and tip and extends outwardly away from the pole a selected distance to form an equivalent to a basket or ring to prevent excess penetration of the pole into the snow.

10 Claims, 1 Drawing Sheet

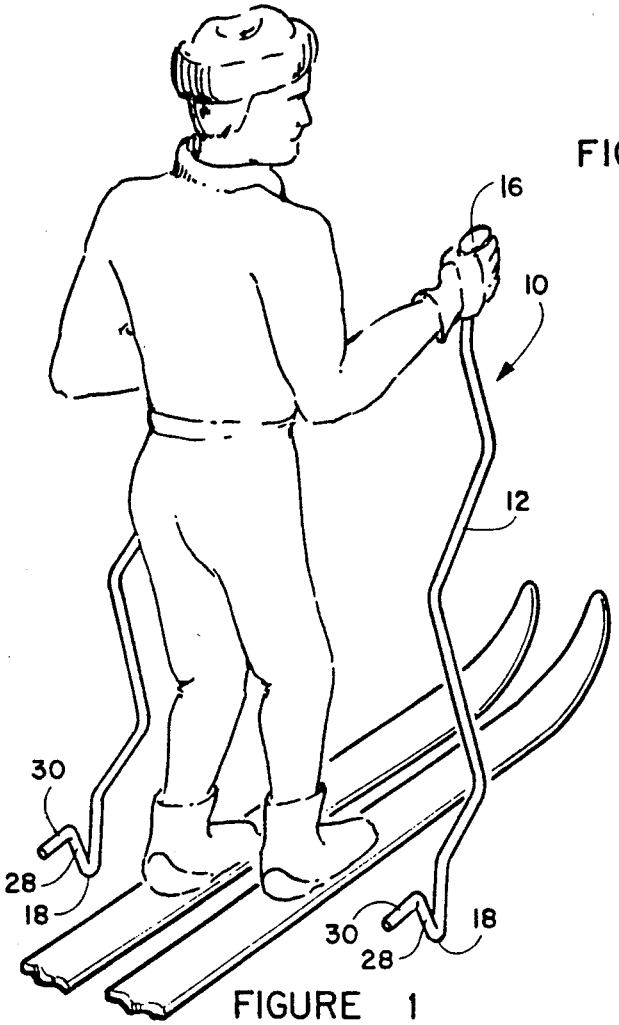
FIGURE 1
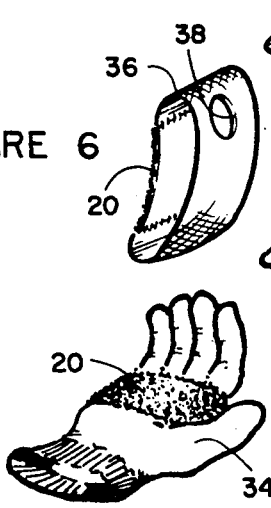
FIGURE 6
FIGURE 5
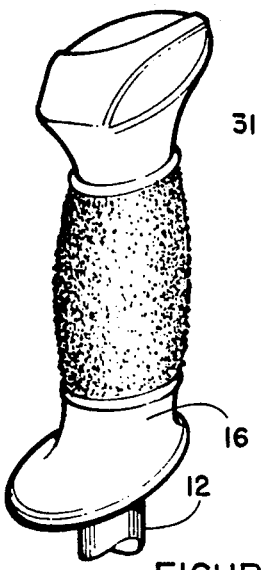
FIGURE 3
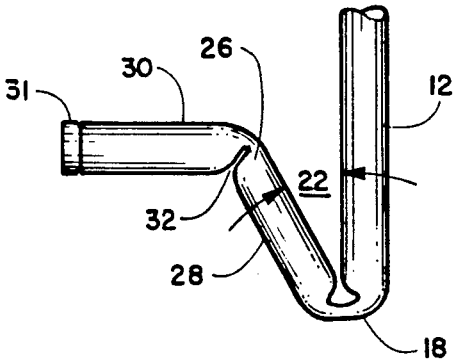
FIGURE 4
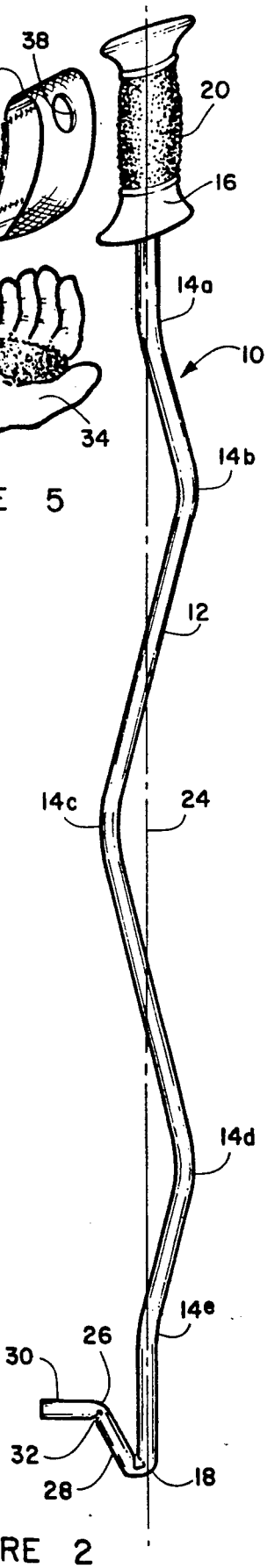
FIGURE 2

SKI POLE

BACKGROUND OF THE INVENTION

The invention is directed to a ski pole and, more particularly, to a ski pole whose shaft between the coaxial handle end and snow embedding tip includes a plurality of obtuse angled bends, has an improved skier gripping system and has an equivalent basket formed by bending the snow penetrating tip back upward toward the handle end and then bending the tip end at an obtuse angle which extends a selected distance from the axis of the handle and pole end or tip and is normal to that axis.

Ski poles are commonly used by a skier to aid skiing maneuvers in Alpine, in down hill, slalom, competition and cross-country activity and in cross-country skiing, for pleasure, competition, long-distance skiing and the like. The ski pole provides balance, facilitate turning and is used to propel the skier and even assist in braking the movement of the skier.

Generally the skier holds one pole in each hand and each pole can comprise a shaft or shank which can be composed of metal or synthetic resin or either solid or the more preferable tube like form, and which is provided with a grip at its upper end and a point at its lower end.

The grip may be formed as a sleeve around the shaft and thus has a axis coincident with that of the shaft. A flexible or resilient open or closed loop or strap can be affixed to the head or distal end of the grip to be fitted over the wrist and thereby prevent loss of the poles.

Generally, the point is adapted to bite into the snow or ice and projects somewhat beyond a basket in the form of a disk or ring adjacent to or near the lower end of the pole to prevent excess penetration of the poles into the snow and to enable the pole to gain a more effective purchase of the snow.

The grip can be molded from any suitable resilient material such as plastic, rubber or the like.

Improved skills of the skiers have required more sophisticated skiing equipment and particularly poles which allow the skier better balance and a greater ability to maneuver and stop.

The loop or strap is always a problem in that in falls or the like the poles remains attached to the arm of the user via the loops or straps. This can be a dangerous condition as the poles can cause injury the user, for example, cause an arm to be broken or tip penetration into the body of the skier.

In some circumstances, the basket or disk can be come detached and lost thereby rendering the pole less useful as to limiting snow depth penetration of the pole.

There has not been a completely successful way to overcome these last mentioned problems until the emergence of the instant invention.

SUMMARY OF THE INVENTION

The ski pole of the present invention utilizes a tubular shaft or pole constructed in the manner well known in this art with an effective tip at the snow penetrating bottom end, a hand grip at the top or skier graspable end and an effective basket near to or adjacent to the bottom end. The hand grip includes a layer of Velcro type hook or eye type fastening material attached thereto with the matting type eye or hook material either carried by the hand or glove of the skier either directly attached to the palm of the glove or in the form of an overlay which is removeably secured over the hand or glove of the skier.

This form of attachment between the skier and the pole will allow the skier to handle the pole with ease and yet the skier will be able to discard or release the pole from the hand easily in the event of a fall or the like. To prevent the loss of the basket under any adverse circumstances, the basket is formed as an extension of the material forming the pole. The bottom end of the pole is folded back on itself toward the handle end at an acute angle by either bending the pole if formed of metal or forming during curing of a pole formed from plastic or the like type material. The folded back pole end is then again bent or formed outwardly at an obtuse angle away from the pole at a location where a basket would normally be placed. The outward end of the protrusion extends to a location which would generally be about the outer periphery of a conventional basket.

To improve the balance of the pole and the stability of the skier, a plurality of obtuse angles are formed between the handle and the tip. The angles are selected so that the maximum width of the pole along any plane does not exceed approximately 6 inches and the handle and tip ends are coaxial.

An object of this invention is to provide an improved and safe pole for a skier aggressive or otherwise.

Another object of this invention is to provide a ski pole which has a means for release from the skier in the event of a fall or the like to prevent injury to the skier.

Still another object of this invention is to provide a ski pole with an equivalent basket formed as apart thereof to prevent loss or the like.

Yet another object of this invention is to improve the balance of a ski pole by providing greater effective width to the pole between handle and tip.

The subject mater which is regarded as this invention is particularly pointed out and distinctly claimed in the concluding portion of the specifications. The invention, however, as to its organization and operation, together with further objects and advantages thereof, will best be understood by reference to the accompanying drawings in which:

BRIEF DESCRIPTION OF THE DRAWING FIGURES

FIG. 1 depicts a skier employing the ski poles of the invention;

FIG. 2 is a side view of the ski pole of the invention;

FIG. 3 is a detailed showing of the handle end of the pole;

FIG. 4 is a detailed showing of the tip end of the pole showing the pole tip formed into an equivalent basket;

FIG. 5 depicts fastening material attached to a skier glove; and

FIG. 6 depicts a strip of VELCRO type hook and eye material worn either over the bare or gloved hand of the skier.

DETAILED DESCRIPTION OF THE PREFERRED EMBODIMENT

Referring to the drawing FIGS. 1-5, FIGS. 1 and 2 show the ski pole 10 of the invention. The pole comprises a shaft 12 formed from any suitable material for the purpose intended having a plurality of angles 14*a*–14*e* located between the coaxial handle portion 16 and the tip or end portion 18. Angles 14*a*, 14*b*, 14*c*, 14*d* and 14*e* are in the range of 145 to 155 degrees preferably about 150 degrees. The combination of the angles chosen for 14*a*–14*e* substantially place the handle 16 and the tip 18 along the center line 24. The widest portions of the pole width vary from 3 to 6 inches with about 4 inches being preferable. The distance of the pole 12 between the pole handle tip and angle 14*a* is between 8 and 15 inches depending on the total pole length requirements of the skier, the length of the pole between 14*a* and 14*b* is in the range of 4.5 to 6.5 inches with substantially 5.5 inches being ideal, the length of the pole between angle 14*b* and angle 14*c* and angles 14*c* and 14*d* are in the range of 9 to 13 inches with substantially 11 inches being ideal, the length of the pole between 14*d* and 14*e* in the range of 4.5 to 6.5 inches with substantially 5.5 inches being ideal and the distance between angle 14*e* and the tip 18 of the pole being in the range of 3.5 to 5 inches with substantially 4.5 inches ideal.

Referring now also to drawing FIG. 3, the handle portion or grip 16 is constructed of resilient material formed of plastic, rubber or the like well known in the art and is either fixedly attached or friction fitted over the pole top end (not shown) and includes at least a partial covering of fastening material 20 either of the hook or eye type mating material. The fastening material is fixedly attached to the handle by means of a suitable adhesive, rivets or the like. A friction fit of the handle portion or grip is preferred as the handle or grip can be removed and the pole sized for the exact length requirement of the skier and then the handle portion or grip can be reinstalled over the pole end. Hook type fastening material 20 is preferred for placement on the handle 16 as it is generally more rigid or stiff and less flexible than the mating eye type material and if the stiffer material were placed on the glove or hand of the skier the feel of the glove or stiffness the hand would be noted and objected to by the skier.

Referring now also to drawing FIG. 4, the tip or bottom snow engaging end 18 of the pole is bent or formed at an acute angle 22 approximately about, 15 degrees which is generally as small as possible depending on the pole diameter. The tip or end 18 is substantially coaxial with the handle 16 along center line 24 while the pole portion between the handle and tip extends from center line 24 several inches to add effective width to the pole for better skier balance and control. At the end 26 of the bent up portion 28 of the tip end 18, an extension 30 is formed by a bend 32 in the pole of an angle selected to place extension 30 substantially normal to center line 24, i.e. the bend angle 22 and bend angle 32 equal substantially 180 degrees. As should readily understood, the extension 30 prevents easy entry of the pole above extension 30 into snow or ice. A plug 31 may be inserted into the open distal end of the extension 30 to seal off the opening and prevent the entry of snow or ice into the pole.

Referring now to drawing FIG. 5, a skier glove 34 is shown with the material 20 (preferably of the eye type) fixedly attached thereto.

Referring now to drawing FIG. 6, a band 36 of eye type fastening material 20 is shown which includes a thumb hole 38 for securing over the thumb of a skier's hand to hold the band 36 in place on the skier's hand.

The pole can be formed in its final stage by casting, bent from a straight pole or otherwise formed by methods well known in the forming art. The pole position of drawing FIG. 1 is shown directing the extension 30 to the rear of the pole, it should be understood that the extension 30 may be directed in any direction that the skier desires to practice this invention.

While described above are the principles of the embodiment of the ski pole of the invention in connection with specific apparatus it is to be clearly understood that this description is made only by way of example and not as a limitation to the scope of the invention as set forth in the summary thereof and in the accompanying claims.

What is claimed is:

1. An improved skier's pole supported by said skier's hand comprising:

a handle member;

a tip;

a pole having a center line with said handle member at one end and said tip at the other end thereof with said center line passing through at least the entire length of said handle member and tip;

a first extension of said tip end formed upward from said tip end toward said handle member a selected distance from said tip along only one side of said pole, the upper end of said first extension remote from said tip end being angled away from said centerline; and a second extension extending from said upper end of said first extension in a direction substantially normal to said centerline.

2. The invention as defined in claim 1 further comprising a plurality of bend angles along said pole between said handle member and said tip.

3. The invention as defined in claim 2 wherein said bend angles are obtuse angles.

4. The invention as defined in claim 3 wherein there are five of said bend angles along said pole between said handle member and said tip.

5. The invention as defined in claim 1 further comprising releasible securing means for securing said pole to the hand of said skier.

6. The invention of claim 5 wherein said releasible securing means is two part VELCRO type material one of said two parts is attached to the skier's hand and the other one of said two parts attached to said handle member.

7. The invention as defined in claim 5 wherein said releasible securing means is two part VELCRO type material with one of said two parts formed as a band placed around the hand of the skier and the other one of said two parts attached to said handle member.

8. The invention as defined in claim 1 wherein said first extension is an extension of the pole formed at an angle from the tip.

9. The invention as defined in claim 1 wherein said second extension is formed as a further extension of said first extension.

10. The invention as defined in claim 8 wherein said second extension is formed as a further extension of said first extension.

* * * * *